US008936094B2

(12) United States Patent
Least et al.

(10) Patent No.: US 8,936,094 B2
(45) Date of Patent: Jan. 20, 2015

(54) ROTATIONAL MOTION-INDUCING FLOW CONTROL DEVICES AND METHODS OF USE

(71) Applicant: Halliburton Energy Services, Inc., Houston, TX (US)

(72) Inventors: Brandon Thomas Least, Dallas, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/112,126

(22) PCT Filed: Dec. 20, 2012

(86) PCT No.: PCT/US2012/070842

§ 371 (c)(1),
(2) Date: Oct. 16, 2013

(87) PCT Pub. No.: WO2014/098859

PCT Pub. Date: Jun. 26, 2014

(65) Prior Publication Data

US 2014/0246206 A1 Sep. 4, 2014

(51) Int. Cl.
*E21B 43/00* (2006.01)
*E21B 34/08* (2006.01)
(Continued)

(52) U.S. Cl.
CPC ..... *E21B 34/06* (2013.01); *E21B 43/12* (2013.01); *E21B 41/0078* (2013.01); *E21B 43/088* (2013.01); *E21B 43/14* (2013.01)
USPC ..... 166/373; 166/205; 166/265; 166/369

(58) Field of Classification Search
CPC ..... B01D 45/16; B01D 17/0217; B01D 19/0094; B04C 3/00; B04C 3/06; E21B 43/38
USPC ..... 166/369, 265, 373, 316, 319, 386, 166/242.1, 105.5, 162, 205; 138/808, 812
See application file for complete search history.

(56) References Cited

U.S. PATENT DOCUMENTS 3,036,810 A * 5/1962 Conrad et al. ..... 251/95
3,719,207 A * 3/1973 Takeda ..... 366/181.5
(Continued)

FOREIGN PATENT DOCUMENTS

DE 3722529 A1 * 1/1989 ..... B05B 1/34
WO 2014098859 A1 6/2014

OTHER PUBLICATIONS

English translation of DE 3722529, translated Jun. 11, 2014.*
(Continued)

*Primary Examiner* — Jennifer H Gay
(74) *Attorney, Agent, or Firm* — McDermott Will & Emery LLP; Scott Richardson

(57) ABSTRACT

An example flow control device includes a body having an inlet and an outlet and a flow chamber extending therebetween. The flow chamber is configured to convey a fluid composition comprising a desired and an undesired fluid from the inlet to the outlet. A nozzle is arranged at the outlet and in fluid communication with the flow chamber, and at least one helical groove is defined along at least a portion of an axial length of the flow chamber. The at least one helical groove is configured to impart rotational motion to the fluid composition and thereby force at least some of the undesired fluid into the at least one helical groove and slow a progress of the undesired fluid along the axial length of the flow chamber.

23 Claims, 3 Drawing Sheets

(51) Int. Cl.

| | |
|---|---|
| ***E21B 34/06*** | (2006.01) |
| ***E21B 43/12*** | (2006.01) |
| ***E21B 41/00*** | (2006.01) |
| ***E21B 43/08*** | (2006.01) |
| ***E21B 43/14*** | (2006.01) |

(56) References Cited

U.S. PATENT DOCUMENTS

| | | | | |
|---|---|---|---|---|
| 4,266,571 | A * | 5/1981 | Bauder | 137/625.48 |
| 5,287,930 | A * | 2/1994 | McGill | 166/373 |
| 5,482,117 | A * | 1/1996 | Kolpak et al. | 166/265 |
| 6,026,901 | A * | 2/2000 | Brady et al. | 166/265 |
| 6,997,214 | B2 * | 2/2006 | Kuo | 138/39 |
| 7,802,621 | B2 | 9/2010 | Richards et al. | |
| 8,261,839 | B2 | 9/2012 | Fripp et al. | |
| 8,327,885 | B2 | 12/2012 | Dykstra et al. | |
| 2006/0196658 | A1 * | 9/2006 | Belcher | 166/244.1 |
| 2007/0157985 | A1 * | 7/2007 | Caro et al. | 138/40 |
| 2007/0246212 | A1 * | 10/2007 | Richards | 166/227 |
| 2008/0283238 | A1 * | 11/2008 | Richards et al. | 166/228 |
| 2009/0044954 | A1 * | 2/2009 | Caro et al. | 166/369 |
| 2009/0065431 | A1 * | 3/2009 | Bakke et al. | 210/512.1 |
| 2009/0095484 | A1 * | 4/2009 | Huang et al. | 166/319 |
| 2009/0120647 | A1 * | 5/2009 | Turick et al. | 166/373 |
| 2009/0277650 | A1 * | 11/2009 | Casciaro et al. | 166/386 |
| 2009/0301726 | A1 * | 12/2009 | Coronado | 166/319 |
| 2011/0030969 | A1 * | 2/2011 | Richards | 166/373 |
| 2011/0056686 | A1 * | 3/2011 | Clem | 166/278 |
| 2011/0079396 | A1 | 4/2011 | Russell et al. | |
| 2012/0111577 | A1 | 5/2012 | Dykstra et al. | |
| 2012/0181036 | A1 | 7/2012 | Holderman | |
| 2012/0181037 | A1 | 7/2012 | Holderman | |
| 2012/0255740 | A1 | 10/2012 | Fripp et al. | |
| 2014/0014320 | A1 * | 1/2014 | Soni et al. | 166/162 |

OTHER PUBLICATIONS

International Search Report and Written Opinion for PCT/US2012/070842 filed Aug. 27, 2013.

* cited by examiner

ROTATIONAL MOTION-INDUCING FLOW CONTROL DEVICES AND METHODS OF USE

BACKGROUND

The present invention generally relates to wellbore flow control devices and, more specifically, to autonomous inflow control devices and methods of use thereof.

In hydrocarbon production wells, it is often beneficial to regulate the flow of formation fluids from a subterranean formation into a wellbore penetrating the same. A variety of reasons or purposes can necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

A number of devices are available for regulating the flow of formation fluids. Some of these devices are non-discriminating for different types of formation fluids and can simply function as a "gatekeeper" for regulating access to the interior of a wellbore pipe, such as a well string. Such gatekeeper devices can be simple on/off valves or they can be metered to regulate fluid flow over a continuum of flow rates. Other types of devices for regulating the flow of formation fluids can achieve at least some degree of discrimination between different types of formation fluids. Such devices can include, for example, tubular flow restrictors, nozzle-type flow restrictors, autonomous inflow control devices, non-autonomous inflow control devices, ports, tortuous paths, combinations thereof, and the like.

Autonomous inflow control devices can be particularly advantageous in subterranean operations, since they are able to automatically regulate fluid flow without the need for operator control due to their design. In this regard, autonomous inflow control devices can be designed such that they provide a greater resistance to the flow of undesired fluids (e.g., gas and/or water) than they do desired fluids (e.g., oil), particularly as the percentage of the undesired fluids increases. A number of autonomous inflow control device designs suitable for use in subterranean operations are known in the art. However, it nonetheless remains advantageous to develop and design improved autonomous inflow control devices that maximize production efficiency at lower costs.

SUMMARY OF THE INVENTION

The present invention generally relates to wellbore flow control devices and, more specifically, to autonomous inflow control devices and methods of use thereof.

In some embodiments, a flow control device is disclosed. The flow control device may include a body having an inlet and an outlet and a flow chamber extending therebetween, the flow chamber being configured to convey a fluid composition comprising one of a desired fluid or an undesired fluid from the inlet to the outlet, wherein the undesired fluid is more dense or less viscous than the desired fluid, a nozzle arranged at the outlet and in fluid communication with the flow chamber, and at least one helical groove defined along at least a portion of an axial length of the flow chamber, the at least one helical groove being configured to impart rotational motion to the fluid composition and thereby force at least some of the undesired fluid into the at least one helical groove, thereby slowing its progress along the axial length of the flow chamber.

In other embodiments, a method of regulating fluid flow is disclosed. The method may include receiving a fluid composition in a flow control device comprising a body having an inlet and an outlet and a flow chamber extending therebetween, the fluid composition comprising one of a desired fluid and an undesired fluid, wherein the undesired fluid is more dense or less viscous than the desired fluid, imparting rotational motion to the fluid composition and thereby forcing a portion of the undesired fluid into at least one helical groove defined along at least a portion of an axial length of the flow chamber, and conveying the portion of the undesired fluid along the axial length of the flow chamber within the at least one helical groove, thereby slowing an axial progress of the portion of the undesired fluid.

In yet other embodiments, a method of producing a fluid composition may be disclosed. The method may include drawing the fluid composition through a well screen arranged about a production tubular, the fluid composition comprising one of a desired fluid and an undesired fluid wherein the undesired fluid is more dense or less viscous than the desired fluid, receiving the fluid composition in a flow control device arranged within a housing coupled to the well screen, the flow control device comprising a body having an inlet and an outlet and a flow chamber extending therebetween, imparting rotational motion to the fluid composition and thereby forcing a portion of the undesired fluid into at least one helical groove defined along at least a portion of an axial length of the flow chamber, and conveying the portion of the undesired fluid along the axial length of the flow chamber within the at least one helical groove, thereby slowing an axial progress of the portion of the undesired fluid.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention generally relates to wellbore flow control devices and, more specifically, to autonomous inflow control devices and methods of use thereof.

The present disclosure describes exemplary flow control devices that may be able to improve completion reliability and efficiency by smoothing production throughout a production interval in a wellbore. This may be accomplished by imparting rotational motion to an incoming fluid into the exemplary flow control devices. Rotational motion can be particularly effective for variably restricting fluid flow within a flow control device. Upon being subjected to the rotational forces induced by the flow control device, undesired components of the fluid composition may undergo greater rotational motion than desired components of the fluid composition. As a result, the undesired component traverses a longer flow pathway than does the desired component, and the undesired component's residence time within the flow control device will be increased.

In some embodiments, the design of the exemplary flow control devices can be such that only fluids having certain physical properties will undergo a desired degree of rotational motion therein. That is, in some embodiments, the design of an exemplary flow control device can be configured to take advantage of a fluid's physical properties such that at least one physical property dictates the fluid's rate of passage through the flow control device. Specifically, fluids having certain physical properties (e.g., viscosity, velocity and/or density) can be induced to undergo greater rotational motion when passing through the flow control device, thereby increasing their transit time relative to fluids lacking that physical property. For example, in some embodiments, a flow control device may be configured to induce increasing rotational motion of a fluid with decreasing fluid viscosity. Consequently, in such embodiments, a fluid having a greater viscosity (e.g., oil) may undergo less rotational motion when passing through the flow control device than does a fluid having a lower viscosity (e.g., gas or water), and the high viscosity fluid may have its transit time through the flow control device affected to a much lesser degree than does the low viscosity fluid.

Figure 1:
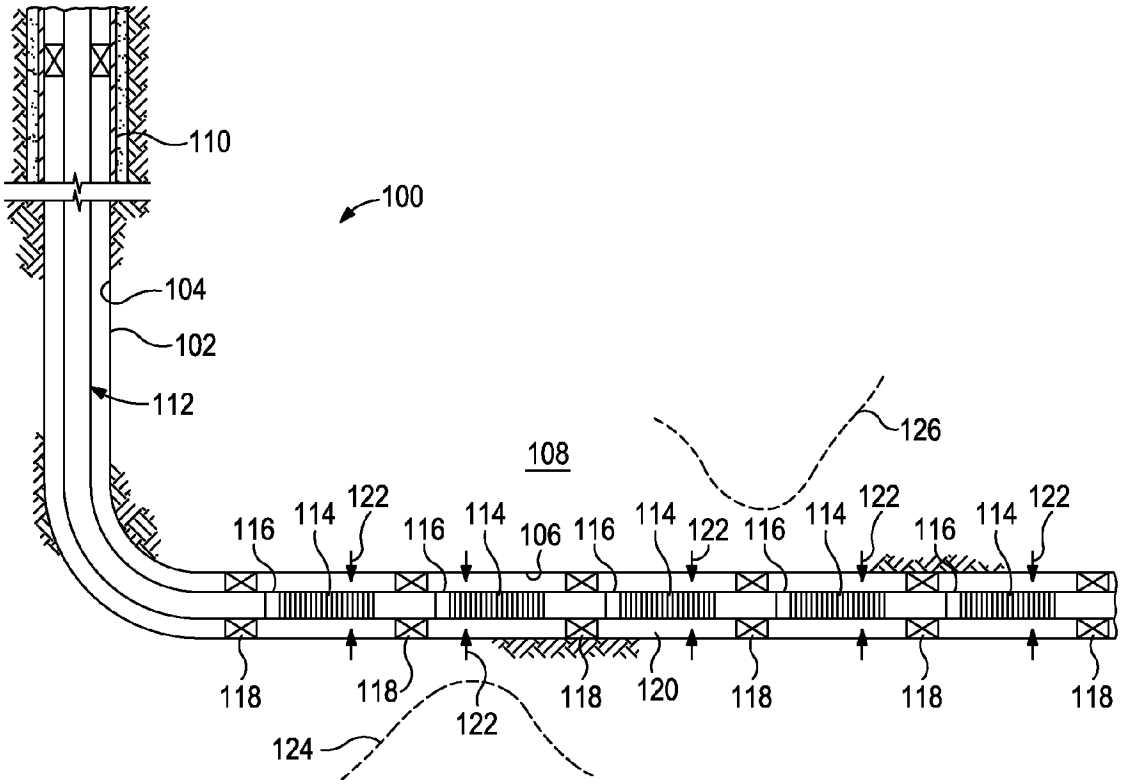
FIG. 1 illustrates a cross-sectional view of a well system which can embody principles of the present disclosure.

Referring to FIG. 1, illustrated is a well system 100 which can embody principles of the present disclosure, according to one or more embodiments. As illustrated, the well system 100 may include a wellbore 102 that has a generally vertical uncased section 104 that transitions into a generally horizontal uncased section 106 extending through a subterranean earth formation 108. In some embodiments, the vertical section 104 may extend downwardly from a portion of the wellbore 102 having a string of casing 110 cemented therein. A tubular string, such as production tubing 112, may be installed in or otherwise extended into the wellbore 102.

One or more well screens 114, one or more flow control devices 116, and one or more packers 118 may be interconnected along the production tubular 112, such as along portions of the production tubular 112 in the horizontal section 106 of the wellbore 102. The packers 118 may be configured to seal off an annulus 120 defined between the production tubular 112 and the walls of the wellbore 102. As a result, fluids 122 may be produced from multiple intervals or "pay zones" of the surrounding subterranean formation 108 via isolated portions of the annulus 120 between adjacent pairs of the packers 118.

As illustrated, in some embodiments, a well screen 114 and a flow control device 116 may be interconnected in the production tubular 112 and positioned between a pair of packers 118. In operation, the well screen 114 may be configured to filter the fluids 122 flowing into the production tubular 112 from the annulus 120. The flow control device 116 may be configured to restrict or otherwise regulate the flow of the fluids 122 into the production tubular 112, based on certain physical characteristics of the fluids.

It will be appreciated that the well system 100 of FIG. 1 is merely one example of a wide variety of well systems in which the principles of this disclosure can be utilized. Accordingly, it should be clearly understood that the principles of this disclosure are not necessarily limited to any of the details of the depicted well system 100, or the various components thereof, depicted in the drawings or otherwise described herein. For example, it is not necessary in keeping with the principles of this disclosure for the wellbore 102 to include a generally vertical wellbore section 104 or a generally horizontal wellbore section 106. Moreover, it is not necessary for fluids 122 to be only produced from the formation 108 since, in other examples, fluids could be injected into the formation 108, or fluids could be both injected into and produced from the formation 108, without departing from the scope of the disclosure.

Furthermore, it is not necessary that at least one well screen 114 and flow control device 116 be positioned between a pair of packers 118. Nor is it necessary for a single flow control device 116 to be used in conjunction with a single well screen 114. Rather, any number, arrangement and/or combination of such components may be used, without departing from the scope of the disclosure. In some applications, it is not necessary for a flow control device 116 to be used with a corresponding well screen 114. For example, in injection operations, the injected fluid could be flowed through a flow control device 116, without also flowing through a well screen 114.

It is not necessary for the well screens 114, flow control devices 116, packers 118 or any other components of the production tubular 112 to be positioned in uncased sections 104, 106 of the wellbore 102. Rather, any section of the wellbore 102 may be cased or uncased, and any portion of the production tubular 112 may be positioned in an uncased or cased section of the wellbore 102, without departing from the scope of the disclosure.

Those skilled in the art will readily recognize the advantages of being able to regulate the flow of fluids 122 into the production tubular 112 from each zone of the subterranean formation 108, for example, to prevent water coning 124 or gas coning 126 in the formation 108. Other uses for flow regulation in a well include, but are not limited to, balancing production from (or injection into) multiple zones, minimizing production or injection of undesired fluids, maximizing production or injection of desired fluids, etc. The exemplary flow control devices 116, as described in greater detail below, may provide such benefits by increasing resistance to flow if a fluid velocity increases beyond a selected level (e.g., to thereby balance flow among zones, prevent water coning 124 or gas coning 126, etc.), increasing resistance to flow if a fluid viscosity or density decreases below a selected level (e.g., to thereby restrict flow of an undesired fluid, such as water or gas, in an oil producing well), and/or increasing resistance to flow if a fluid viscosity or density increases above a selected level (e.g., to thereby minimize injection of water in a steam injection well).

Whether a fluid is a desired or an undesired fluid depends on the purpose of the wellbore operation being conducted. For example, if it is desired to produce oil from a well, but not to produce water or gas, then oil is a desired fluid and water and gas are undesired fluids. If it is desired to produce gas from a well, but not to produce water or oil, the gas is a desired fluid, and water and oil are undesired fluids. If it is desired to inject steam into a formation, but not to inject water, then steam is a desired fluid and water is an undesired fluid. Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

Figure 2:
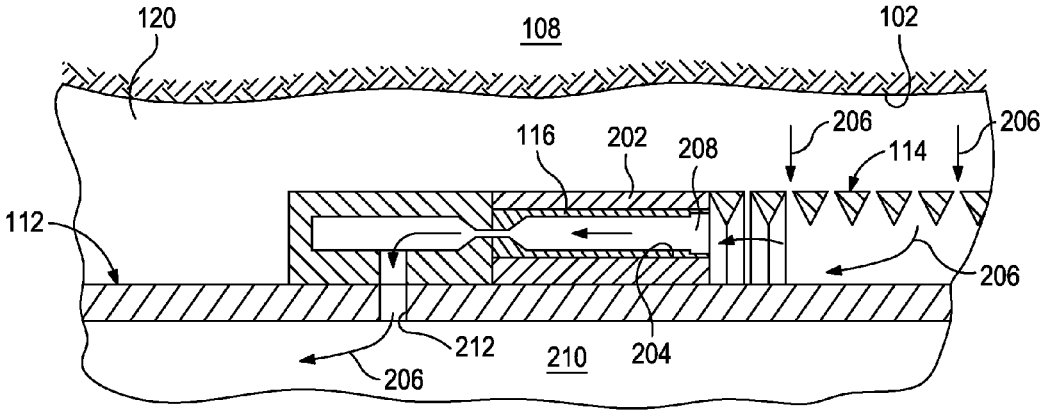
FIG. 2 is an enlarged cross-sectional view of one of the flow control devices and a portion of one of the well screens of FIG. 1, according to one or more embodiments.

Referring now to FIG. 2, with continued reference to FIG. 1, illustrated is an enlarged cross-sectional view of one of the flow control devices 116 and a portion of one of the well screens 114, according to one or more embodiments. As illustrated, the flow control device 116 may be arranged within a housing 202 operably coupled to the production tubing 112. The well screen 114 may be coupled to or otherwise attached to the housing 202 and extend axially therefrom about the exterior of the production tubing 112. In some embodiments, the well screen 114 may be of the type known to those skilled in the art as a wire-wrapped well screen. In other embodiments, however, the well screen 114 may be any other type or combination of well screen such as, but not limited to, sintered screens, expandable screens, pre-packed screens, wire mesh screens, combinations thereof, and the like.

In some embodiments, the flow control device 116 may be formed as an integral part of or otherwise defined by the housing 202, such as by machining or the like. In other embodiments, however, the flow control device 116 may be a separate mechanical component that may be installed or otherwise inserted into the housing 202 in a cavity 204 suitably-defined in the housing 202 for the receipt of the flow control device 116. The flow control device 116 may be secured to the housing 202 within the cavity 204 using several methods or techniques known to those skilled in the art. For instance, the flow control device 116 may be installed and secured in the housing 202 by shrink-fitting, press-fitting, o-ring seals, mechanical fasteners, welding, brazing, industrial adhesives, threading, combinations thereof, and the like.

In exemplary operation, a fluid 206 from the annulus 120 may flow through the well screen 114 and is thereby filtered before flowing into an inlet 208 of the flow control device 116. In at least one embodiment, the fluid 206 may be received from regions of a well other than the annulus 120. In some embodiments, the fluid 206 may be a fluid composition originating from the surrounding formation 108 and may include one or more fluid components, such as oil and water, oil and gas, gas and water, oil, water and gas, etc. Depending on the application, such fluids and/or fluid components may be considered undesired or desired fluids or fluid components. Flow of the fluid 206 through the flow control device 116 may be resisted based on one or more characteristics of the fluid 206, such as the density, the viscosity, or the velocity of the fluid 206 or its various fluid components. After passing through the flow control device 116, the fluid 206 may then be discharged therefrom and eventually conveyed to an interior 210 of the production tubular 112 via one or more flow ports 212 defined therein.

While FIG. 2 depicts a single flow control device 116 being used in conjunction with a single well screen 114, those skilled in the art will readily appreciate that multiple flow control devices 116 may be used with one or multiple well screens 114, without departing from the scope of the disclosure. For instance, in some embodiments, multiple flow control devices 116 may be arranged in parallel within the housing 202 and configured to receive the fluid 206 from one or more well screens 114. In other embodiments, multiple flow control devices 116 may be arranged in series (e.g., outlet to inlet arrangement of flow control devices 116) within the housing 202 and configured to receive the fluid 206 in sequence from one or more well screens 114. In some embodiments, the flow control device 116 may be arranged such that the fluid 206 flows through the flow control device 116 prior to flowing through the well screen 114. Accordingly, it will be appreciated that the principles of this disclosure are not limited to the details or structural configurations of the particular embodiment depicted in FIG. 2.

Further, it is to be recognized that the orientation of the flow control devices 116 may not be particularly limited. In some embodiments, for example, the flow control devices 116 can be oriented substantially parallel to the axis of the production tubular 112, as illustrated. In other embodiments, however, the flow control devices 116 can be oriented substantially perpendicular to the axis of the production tubular 112. That is, the flow pathway established by the flow control devices 116 can be either substantially parallel or substantially perpendicular to the production tubular 112 in various embodiments. In yet other embodiments, the flow pathway established by the flow control devices 116 may be slanted or otherwise arranged at any angle ranging between parallel and perpendicular to the longitudinal axis of the production tubular 112, without departing from the scope of the disclosure.

Figure 3:
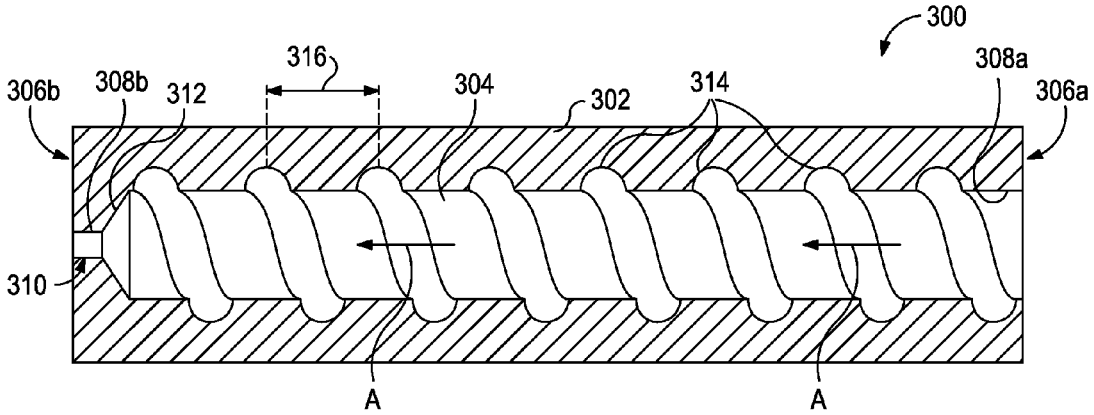
FIG. 3 illustrates a cross-sectional view of an exemplary flow control device, according to one or more embodiments.

Referring now to FIG. 3, with continued reference to FIGS. 1 and 2, illustrated is a cross-sectional view of an exemplary flow control device 300, according to one or more embodiments. The flow control device 300 may function somewhat similar to the flow control device 116 of FIGS. 1 and 2 and therefore may be best understood with reference thereto. As illustrated, the flow control device 300 may include a generally elongate body 302 having a first end 306*a* and a second end 306*b* and a flow chamber 304 extending longitudinally therebetween. The flow chamber 304 may be defined or otherwise formed in the body 302 and fluids flowing through the flow chamber 304 may proceed generally in the direction indicated by the arrows A.

The first end 306*a* may provide an inlet 308*a* to the flow chamber 304 and the second end 306*b* may provide an outlet 308*b* from the flow chamber 304. In some embodiments, the inlet 308*a* may be or otherwise include the inlet 208 of FIG. 2. In other embodiments, however, the inlet 308*a* may be a distinct feature of the flow control device 300 that fluidly communicates with the inlet 208 of FIG. 2 such that they mutually form a contiguous fluid flow path for fluids from the well screen 114 (FIG. 2) to enter the flow control device 300.

In some embodiments, as illustrated, the outlet 308*b* may define or otherwise provide a nozzle or nozzle-type flow restrictor 310 in fluid communication with the flow chamber 304. In at least one embodiment, the nozzle 310 may form an integral part of the flow chamber 304. The nozzle 310 may be configured to regulate fluid flow through the flow control device 300 by generating a pressure drop across the flow control device 300 that generally restricts the fluid flow therethrough. As a result, the flow control device 300 may at least partially operate as a passive inflow control device, as known by those skilled in the art. In at least one embodiment, the nozzle 310 may define or otherwise provide a bowl 312 that provides a tapered transition from the flow chamber 304 to the outlet 308*b*. In one or more embodiments, the bowl 312 may be configured to induce or otherwise enhance rotation of the fluid flowing through the flow control device 300 prior to entering outlet 308*b*.

The flow control device 300 may further define or otherwise provide one or more helical grooves 314 that may spiral along all or a portion of the inner circumferential surface of the flow chamber 304. In some embodiments, the pitch 316 of the helical groove 314 may remain substantially constant along the flow chamber 304, as illustrated. In other embodiments, however, the pitch 316 may vary along the flow chamber 304, without departing from the scope of the disclosure. The helical groove 314 may provide the flow control device 300 with the ability to differentiate between various fluid components of the fluid 206, thereby delaying the production of undesired fluids (e.g., water and gas) and simultaneously allowing for more efficient production of desired fluids (e.g., oil).

Specifically, the helical groove 314 may be configured to impart, induce, or otherwise cause the incoming fluid 206 to spin or rotate upon entering the flow control device 300. In some embodiments, the tapered surface of the bowl 312 may be configured to enhance or otherwise amplify the rotational motion of the fluid 206 as it approaches the outlet 308*b*. As a result, the fluid 206 may be subjected to centrifugal or vortex forces that may cause a fluid (or fluid component) that is more dense and/or less viscous (i.e., an undesired fluid or fluid component) to collect or otherwise congregate in the helical groove 314 as the fluid 206 progresses in the direction A. On the other hand, fluids (or fluid components) that are less dense and/or otherwise more viscous (i.e., a desired fluid or fluid component) may be less susceptible to the centrifugal or vortex forces and will therefore generally flow through the center of the flow control device 300 and more directly to the outlet 308*b*. Consequently, the undesired fluid (or undesired fluid component) may generally follow the path of the helical groove 314 to the outlet 306*b*, thereby being required to traverse a much longer pathway along the axial length of the flow control device 300 than the desired fluid (or desired fluid component). The undesired fluid, therefore, may be delayed in its entrance into the production tubular 112, while production of the desired fluid (or fluid component) may be largely unaffected.

Those skilled in the art will readily recognize the advantages this may provide. For example, in the event there is a water or gas breakthrough in the formation 108 (FIGS. 1 and 2) during production operations, the flow control device 300 may be able to differentiate between the water/gas (i.e., fluids that are more dense and/or less viscous) and the oil (i.e., a fluid that is less dense and/or more viscous). As a result, production of the water/gas (e.g., an undesired fluid) may be substantially delayed as it may be required to traverse the spiraling helical groove 314 before entering the production tubular 112, while production of the oil (e.g., a desired fluid) may be largely unaffected and thereby maximized. In operation, therefore, the flow control device 300 may operate as an autonomous inflow control device that has the ability to sense viscosity changes in incoming fluids and react to such changes, thereby dramatically minimizing water and gas cuts while increasing overall oil production over the life of a well.

Figure 4:
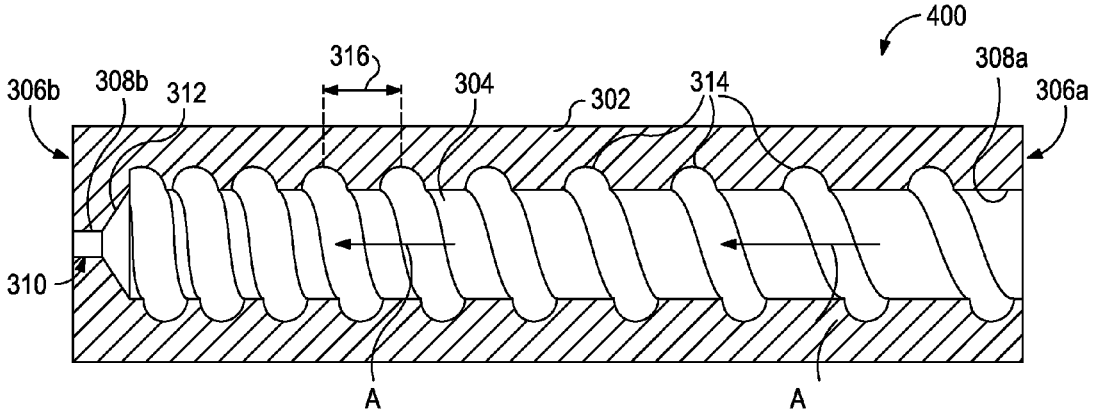
FIG. 4 illustrates a cross-sectional view of another exemplary flow control device, according to one or more embodiments.

Referring now to FIG. 4, with continued reference to FIG. 3, illustrated is a cross-sectional view of another exemplary flow control device 400, according to one or more embodiments. The flow control device 400 may be substantially similar to the flow control device 300 of FIG. 3, and therefore may be best understood with reference thereto where like numerals represent like components not described again. Similar to the flow control device 300 of FIG. 3, the flow control device 400 provides the flow chamber 304, the nozzle 310 defined at the outlet 308*b* or second end 306*b* of the flow chamber 304, and the one or more helical grooves 314 defined on the inner circumferential surface of the flow chamber 304.

Unlike the flow control device 300 of FIG. 3, however, the pitch 316 of the helical groove 314 of the flow control device 400 may vary along the axial length of the flow chamber 304. Specifically, in at least one embodiment, the pitch 316 may progressively decrease along the length of the flow chamber 304 in the direction A that the fluid 206 flows, thereby increasing the distance the undesired fluid (or fluid components) will have to travel. As a result, the axial progress in direction A of undesired fluid (or undesired fluid components) will correspondingly decrease along the axial length of the flow control device 400, thereby delaying production of such undesired fluids even more.

While FIG. 4 depicts the pitch 316 of the helical groove 314 as decreasing along the axial length of the flow chamber 304, those skilled in the art will readily appreciate that the pitch 316 may vary in alternative ways, without departing from the scope of the disclosure. For example, in some embodiments, the pitch 316 may increase along the axial length of the flow chamber 304. In other embodiments, the pitch 316 may alternate between one or more portions that decrease and one or more portions that increase. Those skilled in the art will appreciate that there are several other configurations or degrees of the pitch 316 that may be used in the present embodiments, without departing from the scope of the disclosure.

Figure 5:
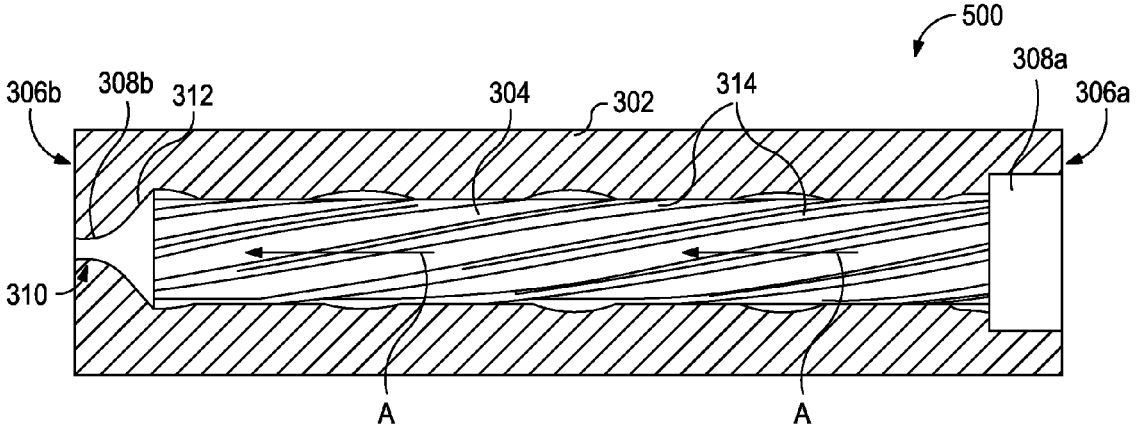
FIG. 5 illustrates a cross-sectional view of another exemplary flow control device, according to one or more embodiments.

Referring now to FIG. 5, with continued reference to FIGS. 3 and 4, illustrated is a cross-sectional view of another exemplary flow control device 500, according to one or more embodiments. The flow control device 500 may be substantially similar to the flow control devices 300 and 400 of FIGS. 3 and 4, respectively, and therefore may be best understood with reference thereto where like numerals again represent like components. Similar to the flow control devices 300 and 400 of FIGS. 3 and 4, respectively, the flow control device 500 provides the flow chamber 304, the inlet 308*a* defined at the first end 306*a* of the flow chamber 304, and the nozzle 310 defined at the outlet 308*b* or second end 306*b* of the flow chamber 304.

Unlike the flow control devices 300 and 400 of FIGS. 3 and 4, however, the pitch 316 (FIGS. 3 and 4) of the one or more helical grooves 314 may be increased dramatically such that the helical grooves 314 may be substantially characterized or otherwise defined as "rifling" grooves in the flow chamber 304. In some embodiments, for example, the lead of each helical groove 314 (i.e., the distance along the longitudinal axis of the flow chamber 304 that is covered by one complete rotation of a helical groove 314) may extend the entire length of the flow chamber 304. In other embodiments, however, the lead of each helical groove 314 may extend across half the flow chamber 304. In yet other embodiments, the lead of each helical groove 314 may extend across more than half the flow chamber 304 but less than the entire length thereof. Those skilled in the art will readily appreciate that various dimensions of pitch 316 and lead may be used or otherwise defined, without departing from the scope of the disclosure.

Those skilled in the art will readily appreciate the several advantages the exemplary flow control devices described herein may provide. For instance, the flow control devices described herein are reliable devices that do not have any moving parts. Nonetheless, the flow control devices may be able to improve completion reliability and efficiency by smoothing production throughout a production interval in a wellbore. As generally described herein, this may be accomplished by delaying the breakthrough of undesired fluids (or undesired fluid components), such as water and gas, from a well. Such a delay in production of these undesired fluids may greatly reduce water and gas production after a breakthrough. As a result, an operator may enjoy increasing ultimate recovery of desired fluids (or desired fluid components), such as oil, from the well.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A flow control device, comprising:

a body having an inlet and an outlet and a flow chamber extending therebetween, the flow chamber being configured to convey a fluid composition comprising a desired fluid and an undesired fluid from the inlet to the outlet, wherein the undesired fluid is at least one of more dense and less viscous than the desired fluid;

a nozzle arranged at the outlet and in fluid communication with the flow chamber; and at least one helical groove defined into an inner surface of the flow chamber along at least a portion of an axial length of the flow chamber, the at least one helical groove being configured to impart rotational motion to the fluid composition to separate a portion of the undesired fluid from a portion of the desired fluid and force the portion of the undesired fluid into the at least one helical groove to slow a progress of the undesired fluid along the axial length of the flow chamber.

2. The flow control device of claim 1, wherein the nozzle comprises a bowl that provides a tapered transition from the flow chamber to the outlet, the bowl being configured to enhance the rotational motion of the undesired fluid as the fluid approaches the outlet.

3. The flow control device of claim 1, wherein the at least one helical groove has a lead that extends the entire axial length of the flow chamber.

4. The flow control device of claim 1, wherein the at least one helical groove comprises a plurality of helical grooves and a pitch of the plurality of helical grooves is constant along the axial length of the flow chamber.

5. The flow control device of claim 1, wherein the at least one helical groove comprises a plurality of helical grooves and a pitch of the plurality of helical grooves varies along the axial length of the flow chamber.

6. The flow control device of claim 5, wherein the pitch progressively decreases along the axial length of the flow chamber.

7. A method of regulating fluid flow, comprising:

receiving a fluid composition in a flow control device comprising a body having an inlet and an outlet and a flow chamber extending therebetween, the fluid composition comprising a desired fluid and an undesired fluid, wherein the undesired fluid is more dense or less viscous than the desired fluid;

imparting rotational motion to the fluid composition with at least one helical groove defined into an inner surface of the flow chamber along at least a portion of an axial length of the flow chamber;

separating a portion of the undesired fluid from a portion of the desired fluid and forcing the portion of the undesired fluid into the at least one helical groove;

conveying the portion of the undesired fluid along the axial length of the flow chamber within the at least one helical groove, thereby slowing an axial progress of the portion of the undesired fluid; and discharging the fluid composition from the flow chamber at the outlet.

8. The method of claim 7, further comprising restricting the fluid flow through the flow chamber with a nozzle arranged at the outlet and in fluid communication with the flow chamber.

9. The method of claim 8, further comprising enhancing the rotational motion of the fluid composition as the fluid composition approaches the outlet with a bowl defined by the nozzle, the bowl providing a tapered transition from the flow chamber to the outlet.

10. The method of claim 7, wherein imparting rotational motion to the fluid composition further comprises increasing the rotational motion of the fluid composition with decreasing fluid viscosity of the fluid composition.

11. The method of claim 7, wherein the at least one helical groove has a lead that extends the entire axial length of the flow chamber.

12. The method of claim 7, wherein the at least one helical groove comprises a plurality of helical grooves and a pitch of the plurality of helical grooves is constant along the axial length of the flow chamber.

13. The method of claim 7, wherein the at least one helical groove comprises a plurality of helical grooves and a pitch of the plurality of helical grooves varies along the axial length of the flow chamber.

14. The method of claim 13, further comprising slowing the axial progress of the portion of the undesired fluid even further with a progressively-decreasing pitch of the plurality of helical grooves along the axial length of the flow chamber.

15. A method of producing a fluid composition, comprising:

drawing the fluid composition through a well screen arranged about a production tubular, the fluid composition comprising a desired fluid and an undesired fluid, wherein the undesired fluid is more dense or less viscous than the desired fluid;

receiving the fluid composition in a flow control device arranged within a housing coupled to the well screen, the flow control device comprising a body having an inlet and an outlet and a flow chamber extending therebetween;

imparting rotational motion to the fluid composition using with at least one helical groove defined into an inner surface of the flow chamber along at least a portion of an axial length of the flow chamber;

separating a portion of the undesired fluid from a portion of the desired fluid and forcing the portion of the undesired fluid into the at least one helical groove;

conveying the portion of the undesired fluid along the axial length of the flow chamber within the at least one helical groove, thereby slowing an axial progress of the portion of the undesired fluid; and discharging the fluid composition from the flow chamber at the outlet.

16. The method of claim 15, further comprising conveying the fluid composition from the flow control device into an interior of the production tubular.

17. The method of claim 15, further comprising restricting the fluid flow through the flow chamber with a nozzle arranged at the outlet and in fluid communication with the flow chamber.

18. The method of claim 17, further comprising enhancing the rotational motion of the undesired fluid as the fluid composition approaches the outlet with a bowl defined by the nozzle, the bowl providing a tapered transition from the flow chamber to the outlet.

19. The method of claim 15, wherein imparting rotational motion to the fluid composition further comprises increasing the rotational motion of the fluid composition with decreasing fluid viscosity of the fluid composition.

20. The method of claim 15, wherein the at least one helical groove has a lead that extends the entire axial length of the flow chamber.

21. The method of claim 15, wherein the at least one helical groove comprises a plurality of helical grooves and a pitch of the plurality of helical grooves is constant along the axial length of the flow chamber.

22. The method of claim 15, wherein the at least one helical groove comprises a plurality of helical grooves and a pitch of the plurality of helical grooves varies along the axial length of the flow chamber.

23. The method of claim 22, further comprising slowing the axial progress of the portion of the undesired fluid even further with a progressively-decreasing pitch of the plurality of helical grooves along the axial length of the flow chamber.

* * * * *